United States Patent [19]

Panttila

[11] Patent Number: 4,909,004

[45] Date of Patent: Mar. 20, 1990

[54] SCREEN APPARATUS

[76] Inventor: Gary E. Panttila, 870 Krpan Dr., Sycamore, Ill. 60178

[21] Appl. No.: 112,618

[22] Filed: Oct. 26, 1987

[51] Int. Cl.[4] ..... E06B 3/00

[52] U.S. Cl. ..... 52/208; 52/202; 160/114; 160/327; 160/354

[58] Field of Search ..... 160/114, 116, 327, 108, 160/113, 122, 354, DIG. 8; 52/202, 203, DIG. 13, 208; 135/120, 87, 117

[56] References Cited

U.S. PATENT DOCUMENTS

| | | | |
|---|---|---|---|
| 328,064 | 10/1885 | Ramser | 160/116 X |
| 1,684,027 | 9/1928 | Hinman | 160/116 X |
| 3,004,592 | 10/1961 | Norton | 160/114 |
| 3,561,518 | 2/1971 | Johnson | 160/327 X |
| 3,753,458 | 4/1972 | Lazarek . | |
| 3,938,577 | 4/1975 | Richards . | |
| 3,943,953 | 3/1976 | Cantwell et al. | 135/117 X |
| 4,068,428 | 10/1976 | Peterson, III . | |
| 4,081,018 | 6/1977 | Szwartz . | |
| 4,231,289 | 11/1980 | Domicent | 135/117 X |
| 4,231,412 | 10/1979 | Nowak . | |
| 4,249,589 | 8/1979 | Loeb . | |
| 4,271,566 | 6/1979 | Perina . | |
| 4,426,816 | 8/1981 | Dean et al. . | |
| 4,562,675 | 1/1986 | Baigas, Jr. et al. | 52/202 |

FOREIGN PATENT DOCUMENTS

| | | | |
|---|---|---|---|
| 1408002 | 6/1965 | France | 160/327 |

*Primary Examiner*—Blair M. Johnson

*Attorney, Agent, or Firm*—Allegretti & Witcoff, Ltd.

[57] ABSTRACT

An improved screen apparatus having a fabric frame and having a Velcro strip attached to one side of such fabric frame, with the mataching Velcro strip attached to the inside of a door frame or other opening at the top and sides thereof, whereby during use the screen device functions to form an adaptable, readily convertible screened-in enclosure.

19 Claims, 2 Drawing Sheets

SCREEN APPARATUS

BACKGROUND OF THE INVENTION

The present invention relates to screen devices in general, and more particularly to an improved screen apparatus for garages and like structures to form convertible and easily removable screened-in enclosures for open structures.

In the prior art, garages or other structures having large doors have had areas of otherwise usable space, but have not had easily removable screens of the appropriate size readily available to form screened-in enclosures. Such screened-in enclosure is necessary in many parts of the country during the Summer months because of the prevalence of flying insects. Also sudden spells of inclement weather can damage materials stored therewithin or render use by occupants uncomfortable.

Some prior art devices have been provided which will diminish somewhat some of the above difficulties, but have proved on the whole in practice to be extremely heavy and/or difficult to install and/or difficult and cumbersome to remove to provide ingress into or egress from such structures. Yet additionally, the openings involved have been of various non-standard sizes, such that openings of great variance in their respective dimensions have been necessary to be utilized, and such that it has been difficult if not impossible to provide such screens in standard sizes which would have great applicability to a wide range of such structures.

In view of the above defects, difficulties and deficiencies, it is a material object of the improved screen apparatus of the present invention materially to alleviate such difficulties.

SUMMARY OF THE INVENTION

The improved screen apparatus of the present invention is generally for use in connection with a structure which defines a substantially closed volume for habitation thereof, such as by persons and/or pets. Such structures in general have at least one opening defining an opening frame.

The improved screen apparatus of the present invention includes screen means, whether of fabric, metal or other material, for disposition across the opening in the structure. Such screen means has a border portion for substantially sealing engagement thereof with the defined opening frame over at least a portion of such opening frame, thereby to increase the degree of enclosure of the structure in a selected amount. Velcro means are disposed at at least part of the border portion of the screen means. Matching Velcro means are matchingly disposed and preferably secured to the frame of the opening of the structure to receive in detachable connected relationship the Velcro means attached to the screen means.

Such Velcro means are disposed over the entire circumference of the border portion, or alternatively in other preferred embodiments, at least portions of the top and sides of the border portion.

Such improved screen apparatus of the present invention may be substantially rectangular in shape, or in alternative embodiments any size and shape as necessary to enclose the frame of such structure.

The features of the present invention will be better understood upon review of the following brief description of the drawing, detailed description of preferred embodiments, appended claims and accompanying drawing.

BRIEF DESCRIPTION OF THE DRAWING

The improved screen apparatus of the present invention is set forth in the accompanying drawing, and in which.

DETAILED DESCRIPTION OF PREFERRED EMBODIMENTS

Figure 1:
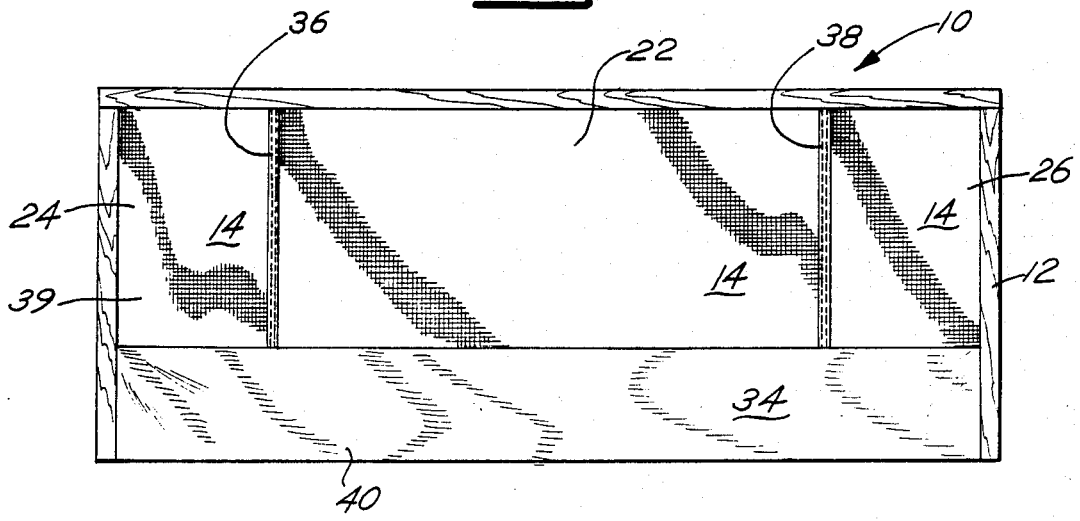
FIG. 1 is a front elevational view of a preferred embodiment of the improved screen apparatus of the present invention, as attached to the opening of a garage structure, and showing a screen element disposed at the upper portion and a fabric element disposed therebelow for increased privacy.

The present invention comprises a screen and/or screen and fabric device having a fabric frame, generally composed of weather-proofed canvas material, sewn or otherwise attached to a fabric/screen material and having disposed at the periphery thereof a Velcro strip attached to one side of the fabric frame, along the outer periphery thereof, and at three sides thereof (top and two sides). Such Velcro strip may be preferably at least one inch in width in preferred embodiments. In such preferred embodiments, a mating two inch Velcro strip is attached to the inside wooden, r the like, door frame member of a domestic garage door opening or similar structure (e.g., posts of a sun-roof, or the like in other environments and embodiments), and around the top and sides thereof. During use, the user joins the two Velcro strips, one with the other, thereby to attain a screened-in enclosure.

The screen element may extend from the top to the bottom of the frame, or, in certain other preferred embodiments extend only to a mid-point or slightly below, with the remainder and lower portion of the space being covered by canvas material for additional privacy. Further, fabric support strips may be provided to extend vertically between the top, middle or bottom, as necessary. In yet other embodiments, a zippered doorway may be provided at one side of the apparatus to allow for simplified and convenient ingress into and egress from the enclosed space. Also, a heavy-duty piece of canvas or rubber may be provided along preferably the outside of the bottom of the structure for water run-off and the like. Moreover, there is preferably no metal or wood in the structure, rendering it light in weight and readily foldable for storage.

The improved screen apparatus of the present invention is intended to be used in connection with a structure defining a substantially closed volume, such as a garage, for habitation thereof. Such structure has at least one opening thereinto, such as a garage door, and which defines an opening frame, such as for example the frame of a garage door. Screen means are provided for disposition across the opening in the structure, such screen means having a border portion thereof for substantially sealing engagement with the opening frame over at least a portion of the opening frame. As indicated, the purpose and functioning of the improved screen apparatus of the present invention is to increase the degree of enclosure of the structure in a selected amount.

Velcro means are disposed on at least a part of the border portion of the screen means, and matching Velcro means are matchingly disposed upon, and preferably secured to, the frame of the opening of the structure to receive the Velcro means in detachable, connectable relationship thereto. Accordingly, the structure is further enclosed to a greater degree for enhanced privacy thereof.

The border portion of the screen means may comprise the entire circumference of the screen means, or in alternative embodiments, at least a portion of the top and sides of the border portion.

The screen means may be substantially rectangular in shape to span a substantially rectangular space, although various other shapes are contemplated. Also, the screen means may enclose in some embodiments only a portion of the opening.

Supplemental cover means are attached to at least a portion of the lower screen means for covering at least a portion of such screen means. Such supplemental cover means may comprise a sheet of film material having an opacity greater than that of the screen for enhancement of privacy over the extent of its disposition. Such supplemental cover means may comprise a fabric, such as canvas, for example.

Such screen means may further include door means for closable entry thereinto. Such door means may be defined by a zipper, or by Velcro means, around at least a portion of the periphery thereof, for ease and convenience of opening nd closing such door.

Also, Velcro backing means may be provided for disposition between the screen means and the Velcro means for providing increased stability and strength to the border portion of the screen means.

The screen means may further include screen hold-down means disposed at at least one bottom portion of the screen means for substantially reducing the tendency of the screen means to flap upwardly.

In some preferred embodiments of the improved screen apparatus of the present invention, the screen hold-down means may include a hold-down weight having a substantial mass and connected to at least one bottom portion of the screen means for holding the screen means in downwardly disposed array. Such screen means may also include pocket means for containing the hold-down weight and with such hold-down weight disposed therein. Such pocket means may be preferably disposed on the inside portion of such apparatus.

The substantially enclosed volume may have inner and outer sides, and with the screen means preferably disposed in some preferred embodiments adjacent the inner side of the opening frame of the substantially enclosed volume.

Such Velcro means are preferably secured to the screen means by means of sewing. The matching Velcro means are preferably fixedly secured to the opening frame of the enclosed volume, such as for example by stapling.

Substantially rain impervious sheeting means may be disposed exteriorally of the screen means to cover at least a portion thereof and for substantially preventing entry of wind and weather into such structure at such covered portion. Said substantially rain impervious sheeting means may comprise polymeric sheeting, and such polymeric sheeting in some preferred embodiments may be substantially transparent. Such rain and pervious sheeting means may be attached to the exterior of said screen means by yet further Velcro strips, which are similar to those described, supra. Such Velcro strips may be disposed at the border portion of the screen means, again in a similar fashion to that described, supra.

A flap means, such as an extension of the supplemental cover means, or in other embodiments a separate but connected element, may be connected to a lower portion of the screen means and disposed in preferably outwardly directed array to reduce the entry of inclemency and run-off of water into such structure.

In partial summary, the improved screen apparatus of the present invention may cover the opening in a garage door with 100% screen, or a selected percentage of screen and a selected percentage of canvas or other material. In some other embodiments, the improved screen apparatus of the present invention may be accompanied with roll up apparatus of the kind within the skill of those having ordinary skill in this and related arts. Printed fabrics may be utilized. The screen and the canvas portion may be formed in a variety of different colors and color combinations. The apparatus hereof may be monogrammed or may include other suitable visual indicia thereon for identification thereof.

The screen may be formed of a fabric screen, or a flexible metallic screen. The supplemental cover means may be formed from canvas, rubber or plastic sheeting. The substantially rain impervious sheeting material may be preferably formed from transparent plastic sheeting, although other materials may be acceptable.

Different sized screens may be presented to fit many different sizes, shapes and/or styles of garage doors and/or garage door openings. One size of screen may be readily altered to fit several different sizes of openings, such as by turning a portion of an oversized screen underneath to form the preferably outwardly disposed bottom flap. Such flap design may in some embodiments include a minimum of a six inch flap to facilitate rain runoff. A further flap may be hemmed for weights and/or for insertion of a tube weight therein. Such tube weight may be disposed either inwardly or outwardly. However, in preferred embodiments, such tube weight is preferably disposed inwardly.

Figure 2:
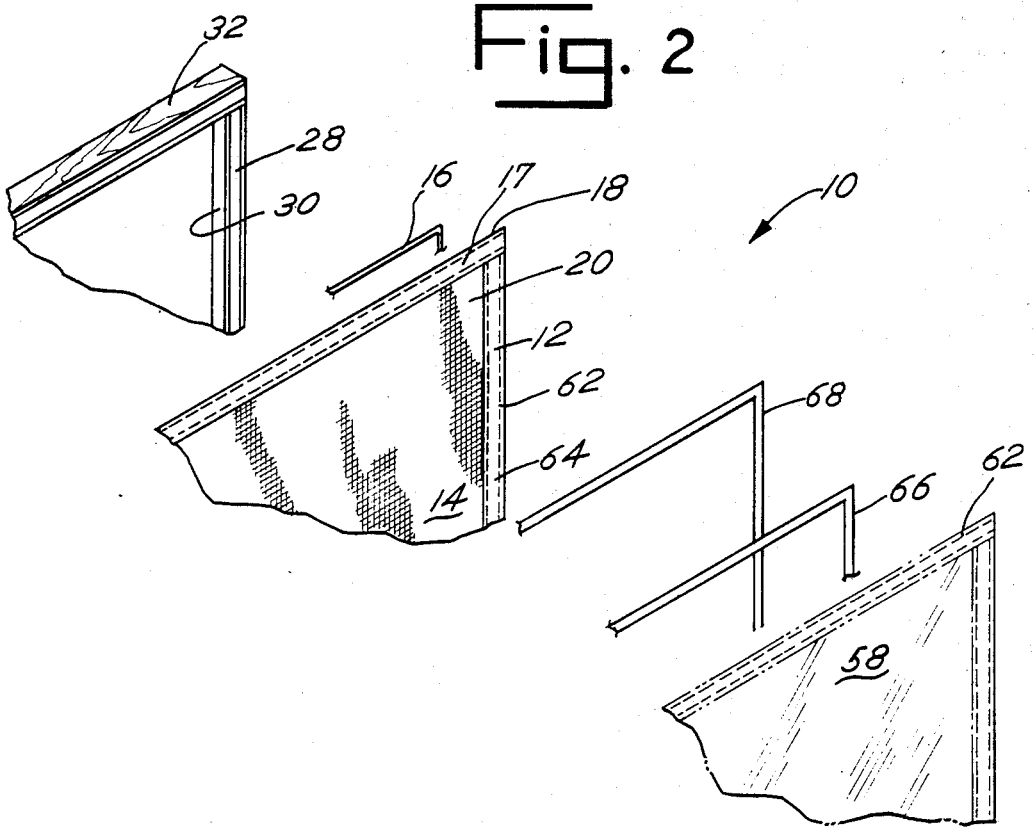
FIG. 2 is an exploded and fragmented perspective view of the improved screen apparatus of the present invention showing the various components thereof along with a clear plastic rain shield (shown in phantom lines) as a further preferred embodiment thereof.
Figure 3:
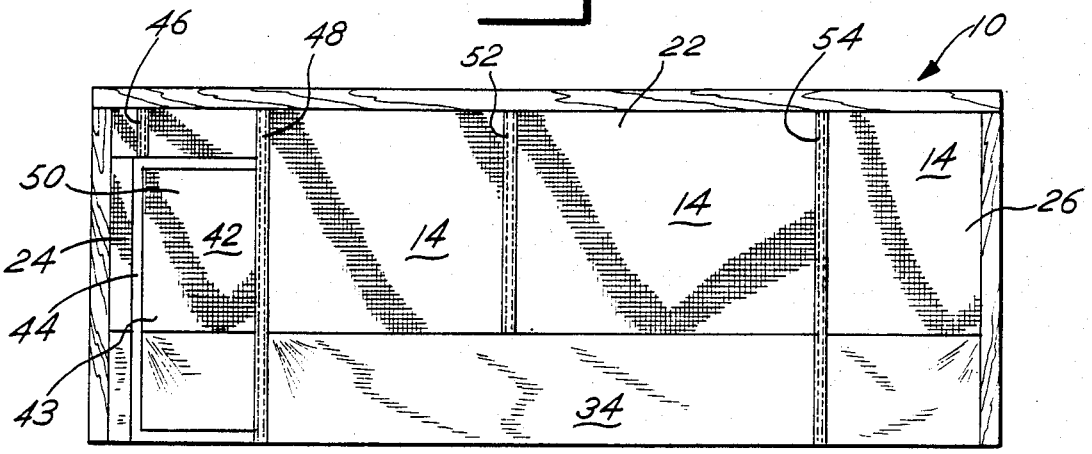
FIG. 3 is a front elevational view of an additional preferred alternative embodiment of the improved screen apparatus of the present invention showing a zipper-closing door structure disposed at one side of such screen.

Referring now to the drawing and to FIGS. 1 and 2 in particular, the improved screen apparatus of the present invention generally designated at 10 comprises a screen device having a fabric frame 12 generally composed of weather-proofed canvas material, sewn or otherwise attached to a screen material 14 and having an approximately one inch Velcro strip 16 attached to the inside 18 of fabric frame 12 and along the outer periphery 20 thereof, at three sides 22, 24, 26 thereof (respectively the top and two sides), as shown in FIGS. 1 and 3. Velcro backing means 17 may be provided for disposition between screen means 14 and the Velcro means 16 for providing increased stability and strength to the border portion of screen means 14. A mating, two inch Velcro strip 28 is attached to the inside portion 30 of wooden or the like door frame member 32 of a domestic garage door opening or similar structure (e.g., posts of a sun-roof or the like), around the top and sides 22, 24, 26 thereof.

During use, the user joins the two Velcro strips 16, 28 one with the other, and readily attains a screened-in enclosure.

Figure 4:
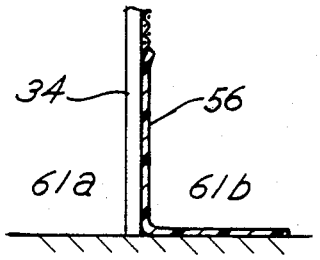
FIG. 4 is a fragmented transverse cross-sectional view of a bottom portion of the improved screen apparatus of the present invention showing an extension of the lower disposed fabric element as shown in FIGS. 1 and 3, and disposed to extend outwardly so as to provide a rain run-off surface to prevent such run-off from entering the structure.
Figure 5:
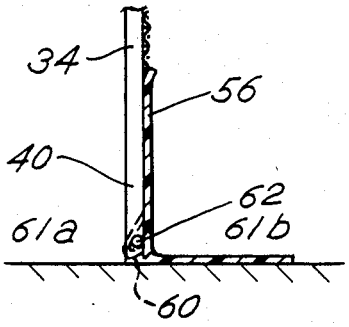
FIG. 5 is a fragmented transverse cross-sectional view of a further embodiment of the improved screen apparatus of the present invention showing a pocket for including a weighted element for holding down the screen at the bottom, inside portion thereof.
Figure 6:
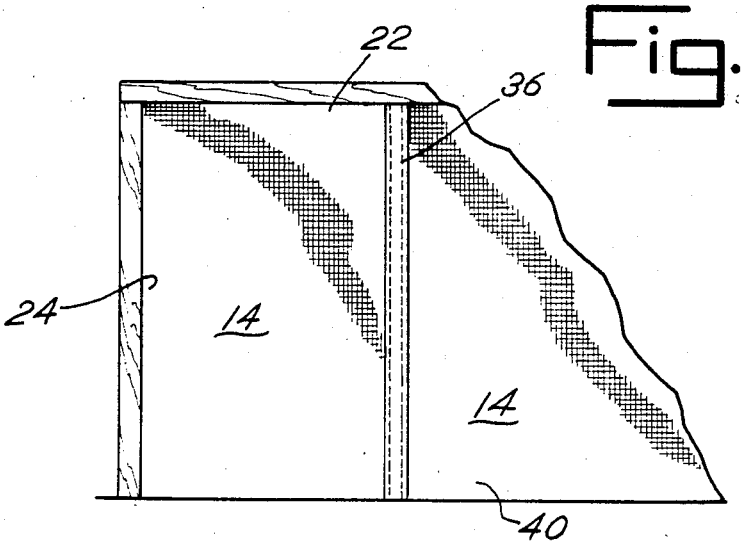
FIG. 6 is a front elevational view of a yet further alternative embodiment of the improved screen apparatus of the present invention showing an all-screen embodiment for enhanced air circulation.

Fabric screen 14 can extend from the top to the bottom of the frame, as shown in FIG. 6, or, extend only to a mid-point or slightly below as shown in FIGS. 1 and 3, with the remainder of the space being taken by canvas or other fabric or opaque material 34 for additional privacy. Further, fabric support strips 36, 38 of FIG. 1 may be provided to extend vertically between top portion 22, middle portion 39 or bottom portion 40 as necessary (See FIG. 1). As shown in FIG. 3, doorway 42 is opened by means of zipper 44 and may be provided along an edge of the apparatus 10 to allow ingress and egress into the enclosed space. Such doorway 42 may be supported by supplemental strips 46, 48 at the top portion 50 thereof, such embodiment of FIG. 3 further including supplemental support strips 52, 54. As shown in FIGS. 4 and 5, a heavy duty piece of unitary or separate canvas, rubber, or other material 56 may be provided along the bottom of canvas material 34 for water run-off and the like.

As shown in FIG. 2, Velcro means 16 are disposed on at least a part of the border portion 20 of screen means 14, and matching Velcro means 28 are matchingly disposed upon, and preferably secured to, frame 32 of the opening of the structure to receive Velcro means 16 in detachable connectable relationship thereto.

Such Velcro means 16 are preferably secured to screen means 14 by means of stitches depicted as dotted lines 62 in FIG. 2.

Border portion 20 of screen means 14 may comprise the entire circumference of screen means 14, or in alternative embodiments at least a portion of top 22 and sides 24, 26 of border 20 portion.

Screen means 14 may be substantially rectangular in shape to span a substantially rectangular space, as shown in the embodiments of FIG. 1–6 hereof, although various other shapes are contemplated. Screen means 14 may enclose in some embodiments only a portion of the opening.

As shown in FIG. 2, supplemental cover means 34 may be attached to at least a portion of screen means 14 for covering at least a portion of screen means 14. Such supplemental cover means 34 may comprise a sheet having an opacity greater than that of the screen for enhancement of privacy over the extent of its disposition.

As shown in FIG. 3, the screen apparatus 10 hereof further may include door means 42 for closable entry thereinto. Such door means 42 may be defined by zipper 44, or other closure means, such as Velcro meand, disposed around at least a portion of periphery 43 thereof for ease and convenience of opening and closing such door means 42.

As shown in FIG. 5, screen means 14 or fabric screen 34 may further include an associated screen hold down pocket 60 disposed at bottom portion 40 of screen means 14 for substantially reducing the tendency of screen means 14 and/or fabric screen 34 to flap outwardly and/or upwardly. In some preferred embodiments of the improved screen apparatus of the present invention 10, screen hold-down pocket 60 may include a hold-down weight 62, such as for example a pipe, having a substantial mass and connected to bottom portion 40 of screen means 14, for holding screen means 14 in downwardly disposed array.

As indicated, supra, the substantially enclosed volume may be defined by an inside and an outside, respectively. **61*a*, 61*b*, as shown in FIGS. 4 and 5, and with screen means 14** preferably disposed therebetween.

As shown in FIG. 2, substantially rain impervious sheeting means 58 may be disposed exteriorly of screen means 14 to cover at least a portion thereof and for substantially preventing entry of wind and weather into such structure at such covered portion. Said substantially rain impervious sheeting means 58 may comprise polymeric sheeting, and such polymeric sheeting in some preferred embodiments may be substantially transparent. Such rain impervious sheeting means 58 may be attached to exterior 64 of said screen means 14 by means of Velcro strips, and mating Velcro strips 66, 68 similar to those described, supra.

As shown in FIGS. 4 and 5, a flap means 56 such as an extension of the supplemental cover means 34, or as a separate element, may be connected to lower portion 40 of screen means 14 and disposed in outwardly directed array to reduce materially the entry of water run-off into such structure.

The basic and novel characteristics of the improved screen apparatus of the present invention will be readily understood from the foregoing disclosure by those skilled in the art. It will become readily apparent that various changes and modifications may be made in the form, construction and arrangement of the improved screen apparatus of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. In a structure defining a substantially closed volume for habitation thereof, and such structure having at least one opening thereinto defining an opening frame, the improvement comprising:

means defining a flexible mesh screen for disposition across the opening in the structure by of said screen means having a border portion for substantially sealing engagement thereof with the opening frame over at least a portion of the opening frame to increase the degree of enclosure of the structure in a selected amount;

first Velcro attachment disposed on at least part of said border portion of said screen;

second Velcro attachment means matchingly disposed upon the frame of the opening of the structure to receive in detachable corrective relationship said first Velcro attachment means;

substantially rain impervious flexible sheeting disposed exteriorly of said screen to cover at least a portion thereof for substantially preventing entry of wind and weather into such structure at such covered portion, and wherein said substantially rain impervious sheeting is attached to the exterior of said screen by third and fourth Velcro attachment means located on a respective screen and sheeting;

whereby the structure if further enclosed to a greater degree.

2. The improvement of claim 1 wherein said border portion of said screen comprises the entire circumference of said screen.

3. The improvement of claim 1 wherein said border portion of said screen comprises at least portions of top and sides of said border portion.

4. The improvement of claim 1 wherein the closed volume is a garage and the opening thereinto is the garage door.

5. The improvement of claim 1 wherein said screen is substantially rectangular in shape to substantially span a substantially rectangular space.

6. The improvement of claim 1 wherein said screen encloses only a portion of said opening.

7. The improvement of claim 1 wherein said screen further comprise door means for closeable entry into the enclosed volume.

8. The improvement of claim 7 wherein said door means is defined by a zipper around at least a portion of the periphery thereof.

9. The improvement of claim 1 further comprising Velcro backing means for disposition between said screen and said first Velcro attachment means for providing increased stability and strength to said border portion of said screen means.

10. The improvement of claim 1 wherein said screen further comprises screen hold down means disposed at at least one bottom portion thereof for substantially reducing the tendency of said screen to flap upwardly.

11. The improvement of claim 10 wherein said screen hold down means comprises a hold down weight having substantial mass and connected to said at least one bottom portion of said screen for holding said screen in downwardly disposed array.

12. The improvement of claim 11 wherein said screen further comprises pocket means for containing said hold down weight and said hold down weight is disposed therein.

13. The improvement of claim 1 wherein the substantially enclosed volume has inner and outer sides and further comprises said screen disposed adjacent the inner side of the opening frame of said substantially enclosed volume.

14. The improvement of claim 1 wherein said first attachment means Velcro is secured to said screen by means of sewing.

15. The improvement of claim 1 wherein said matching Velcro means is fixedly secured to the opening frame of the substantially enclosed volume.

16. The improvement of claim 1 wherein said substantially rain impervious sheeting comprises polymeric sheeting.

17. The improvement of claim 16 wherein said polymeric sheeting is substantially transparent.

18. The improvement of claim 1 wherein said third Velcro attachment means are disposed at said border portion of said screen.

19. The improvement of claim 1 further comprising flap means connected to a lower portion of said screen and disposed outwardly to reduce entry of inclemency thereinto.

* * * * *